United States Patent [19]

Rosenthal et al.

[11] 4,112,714

[45] Sep. 12, 1978

[54] ASYMMETRIC SKEIN DYEING

[75] Inventors: Isadore Rosenthal, Levittown; Lawrence J. Exner, Ambler; Gregory J. Niksa, Collegeville; Warren I. Weiss, Southampton, all of Pa.; Maurice G. Young, Cinnaminson, N.J.

[73] Assignee: Rohm and Haas Company, Philadelphia, Pa.

[21] Appl. No.: 797,096

[22] Filed: May 16, 1977

Related U.S. Application Data

[62] Division of Ser. No. 641,405, Dec. 17, 1975, Pat. No. 4,052,155.

[51] Int. Cl.[2] ..... D06B 1/02; D06B 11/00

[52] U.S. Cl. ..... 68/206

[58] Field of Search ..... 68/206; 8/149, 155.2

[56] References Cited

U.S. PATENT DOCUMENTS

| | | | |
|---|---|---|---|
| 2,043,870 | 6/1936 | Webber | 68/206 X |
| 3,541,635 | 11/1970 | Crenshaw et al. | 68/206 X |
| 3,926,547 | 12/1975 | O'Mahony et al. | 8/149 X |

FOREIGN PATENT DOCUMENTS

| | | | |
|---|---|---|---|
| 97,797 | 9/1924 | Australia | 68/206 |
| 536,904 | 12/1955 | Italy | 68/206 |

*Primary Examiner*—Philip R. Coe
*Attorney, Agent, or Firm*—Patrick C. Baker

[57] ABSTRACT

Chevroning of fabrics made from skein dyed yarns is avoided or controlled by dyeing the yarns such that the color repeat length is greater than the circumference of the skein. In practice this is achieved by horizontally dyeing only a portion of the width of a skein as the skein is held vertically.

10 Claims, 19 Drawing Figures

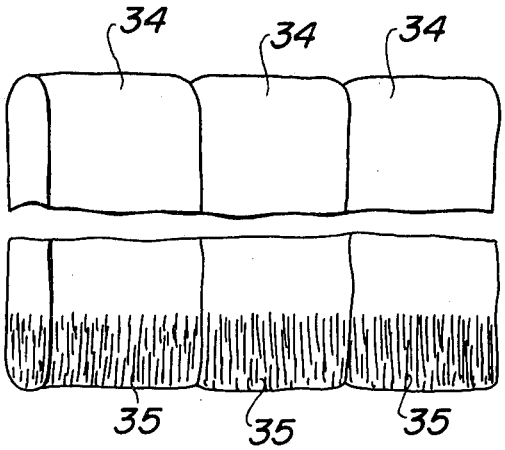
FIG. 3
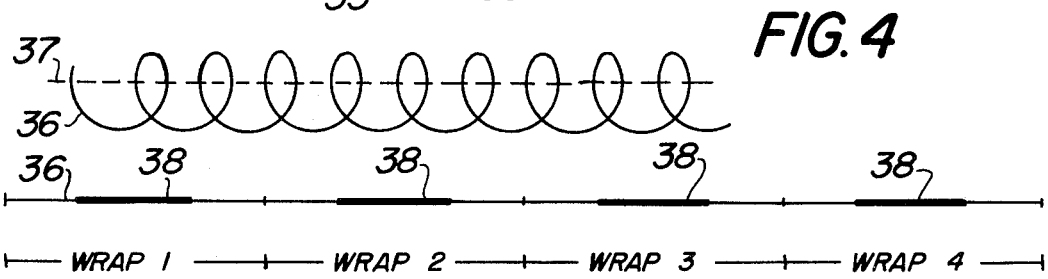
FIG. 4
FIG. 5
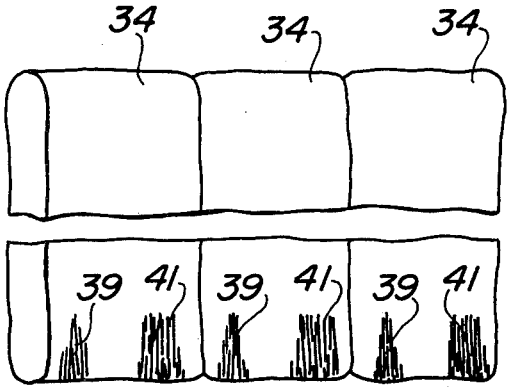
FIG. 6
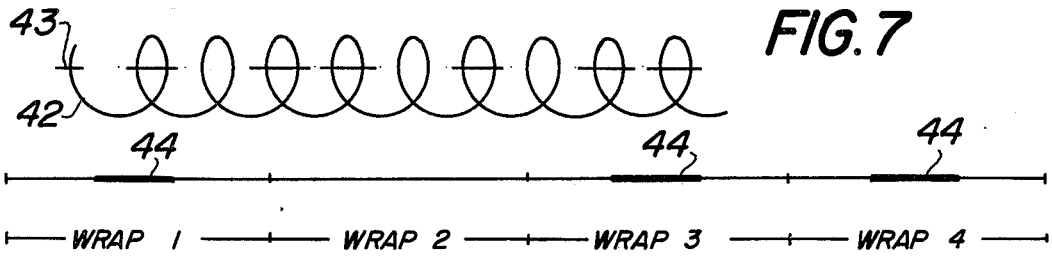
FIG. 7
FIG. 8

FIG. 10
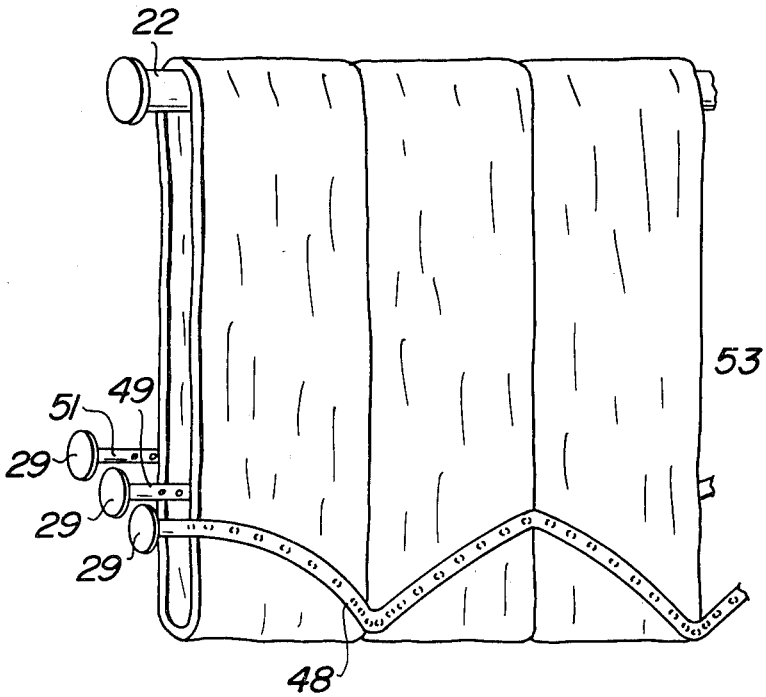
FIG. 11
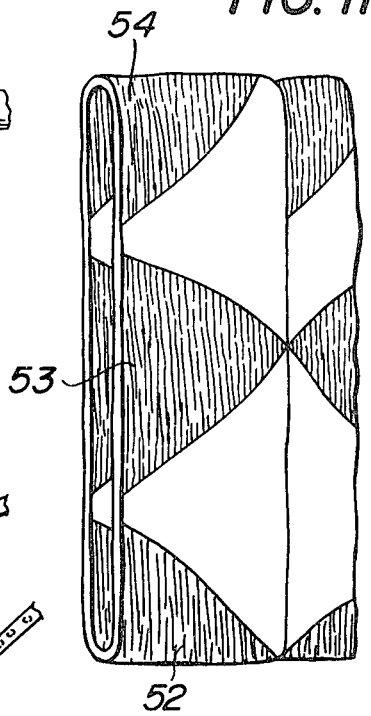
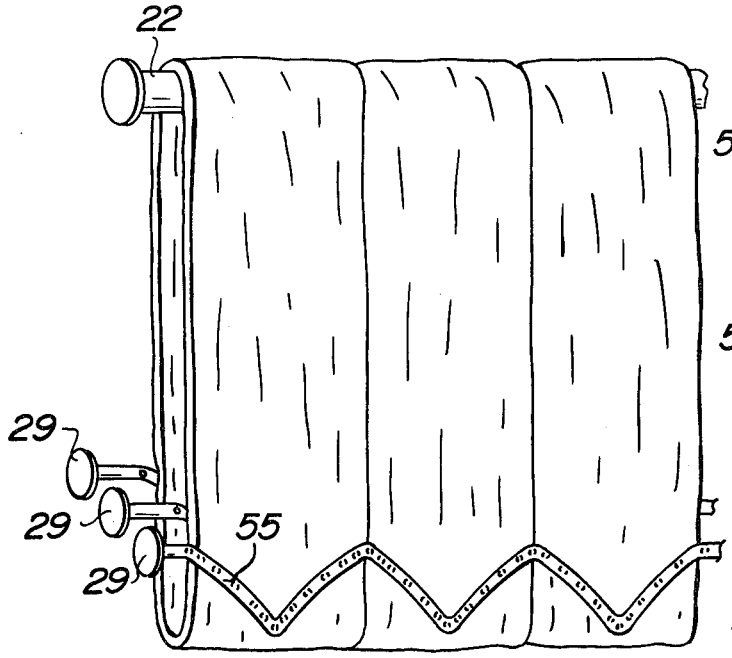
FIG. 12
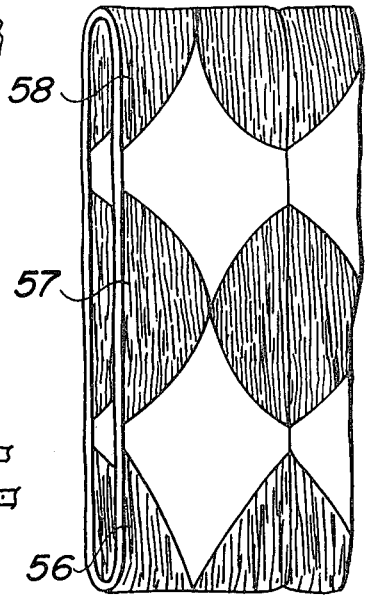
FIG. 13

ASYMMETRIC SKEIN DYEING

This is a division of application Ser. No. 641,405 filed Dec. 17, 1975, and now U.S. Pat. No. 4,052,155.

BACKGROUND OF THE INVENTION

This invention relates to a method and apparatus for skein dyeing which avoids chevron patterns in fabrics made from the skein dyed yarns.

Chevroning in fabrics such as knitted cloth and tufted carpets results from the color contrast dyeing of the yarns used in the fabrics. Such patterning is an undesirable characteristic and is difficult to hide, especially in uniform pile height fabrics and more particularly when a low pile height is required, as in many cut pile (such as plush) or loop pile carpets. While warp printing avoids chevroning, this form of color contrast dyeing does not provide the versatility, clarity, uniformity and fastness of coloration permitted by skein dyeing. In addition, skein dyeing promotes deeper dye penetration since it is based on exhaust dyeing and may be combined with autoclave heat setting to lower processing costs.

Accordingly, an object of the invention is to provide improvements in skein dyeing apparatus so that yarns can be dyed thereby, which yarns do not promote undesirable chevroning in fabrics made therefrom. This and other objects, features and advantages will be apparent from the following description.

In brief outline, the foregoing objects are achieved by asymmetric skein color contrast dyeing of skeins, that is, by a color contrast dyeing technique wherein the color contrast repeat length is greater on the average than the circumference of the yarn in the skein. As a result the color repeat length along yarn unwound from the skein is not regular and this is reflected in the higher degree of random coloration in fabrics made from the yarns required for non-chevroning. In skein dyed yarns which cause chevroning the skein is dyed symmetrically, that is, the color repeat length on the average is the same as the skein circumference and the unwound yarn exhibits regularity of color repeat length.

The asymmetric skein dyeing method of the invention is embodied in the simple but surprisingly efficient step of applying a color contrast dye to less than the entire width, horizontally, of a skein, while the skein is held stationary in a vertical plane. Preferably, less than half the width of the skein is dyed in this manner, such as results from impingement of dye from two or three closely positioned holes in a dye tube placed horizontally and adjacent an exterior side of a skein. The dye thereby impregnates a discrete portion of the skein which is less than its width horizontally, with the result that when the skein is unwound, it will be found that the color repeat length on the average is greater than the length corresponding to the skein circumference. Random coloration is thus introduced along the yarn length, thereby eliminating the chevron patterning in fabrics made from the yarn, which would result had the coloration been regular along the yarn length. The method of the invention also permits non-chevroning skein dyeing of yarn in a plurality of colors, starting with an overall base color and followed by sequential dyeing with two to four, or more, contrast colors.

The method, apparatus and products of the invention are significant improvements over the prior art as represented by U.S. Pat. Nos. 2,043,870 and 3,541,635. Although the skein dyeing in these patents is termed "random," the randomness appears to relate only to height of the dyeing (also known as "dip length") on vertically positioned skeins. The dyeing is across the entire width of the skein and therefore is not asymmetric and will not provide the non-chevroning of the invention.

DETAILED DESCRIPTION

The invention may be understood and appreciated by consideration of the attached figures in which:

FIG. 3 is a fragmented, perspective side view of three skeins of yarn showing prior art dyeing patterns thereon;

FIG. 4 is a diagrammatic view of a portion of yarn unwound from one of the skeins of FIG. 3;

FIG. 5 is a diagrammatic view of the yarn of FIG. 4, straightened out to illustrate dyed portions;

FIGS. 6, 7 and 8 are similar to FIGS. 3, 4, and 5 except that FIGS. 6–8 illustrate dyeing patterns achieved by the present invention;

Figure 1:
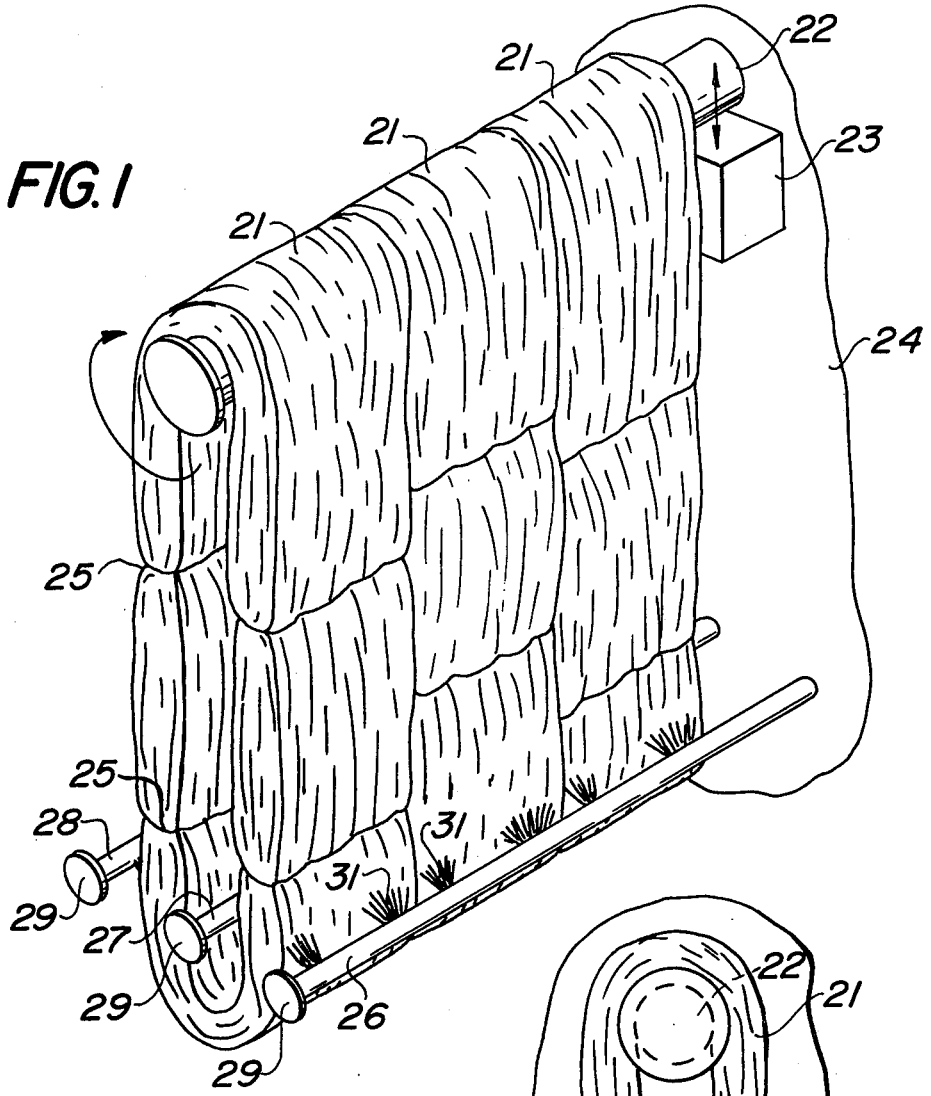
FIG. 1 is a perspective view of apparatus of the invention showing three skeins of yarn in position for dyeing according to the method of the invention.

FIGS. *9a–9g* are fragmented, top plan views of dye tube arrangements useful in apparatus and practice of the invention;

FIGS. 10 and 12 are views similar to FIG. 1 except for certain details but embodying other forms of apparatus of the invention; and FIGS. 11 and 13 are fragmentary views, illustrating skein dyeing patterns achieved by the systems of FIGS. 10 and 12, respectively.

FIG. 1 shows, except for certain modifications to be described, essential elements of apparatus of the well-known Hussong skein dyeing system. In this dyeing system a plurality of skeins 21 of yarn are hung vertically on a rotatable arm 22 within an enclosure (not shown). The enclosure normally includes a dye dip or drip tank positioned below the skeins and a hood or similar structure which fits over the skeins in sealed engagement with the dip tank so that dyeing is confined to a specific area within. The arm 22 may be raised and lowered by a suitable motorized element 23 mounted on a wall 24 of a dye delivery manifold. While FIG. 1 shows three skeins of yarn on the arm 22, the number of such skeins and their dimensions are not important for an understanding of the invention. Conventional Hussong skein dyeing machines are adaptable to a variety of skeins, for example, skeins of about 72–92 inches circumference weighing about 2 to 10 pounds and having widths of about 11 to 18 inches. It is usual practice to dye simultaneously a plurality of skeins on one arm 22. The invention is applicable to such conditions as well as to single arm or multi-arm Hussong-type skein dyeing machines. The yarns of each skein are held loosely in place by ties or "leases" 25 in the usual manner.

Dye delivery means, such as a first dye tube 26, a second dye tube 27 and a third dye tube 28, are positioned below the arm 22 horizontally and generally in the same plane. The first dye tube 26 is positioned adjacent one exterior wall of the skeins 21 and the second dye tube 27 is positioned centrally within the skeins and adjacent their interior walls. The third dye tube 28 is on the opposite side of the skeins from dye tube 26, adjacent the other exterior wall of the skeins 21. Each dye tube has a cap 29 on one end and is connected at the other end to a dye delivery manifold behind wall 24. As shown in FIG. 1, a dye is discharged as a stream 31 from a series of outlets positioned intermittently along the dye tubes. The number and spacing of these dye discharge outlets is significant for the purposes of the invention as will become evident from the discussion below. When the dye delivery means are dye tubes, it is preferred but not critical to mount vertically extending shields or baffles 32 and 33 above and below the central dye tube 27. These may be stainless steel or plastic plates or the like. The shields prevent dye spray from passing through from the outside of the skein to the other side of the skein and also from the inside of the skein to the opposing inside or outside of the skein and thereby confine application of the dye to predetermined areas on the skein. In this connection, the leases 25 tend to cause reflection and splashing of dye; the shields help to minimize this effect.

The principle of the invention will become evident from a consideration of FIGS. 3–8. FIGS. 3–6 represent a conventional skein dyeing result wherein, for example, a base dye is first applied to the entirety of skeins 34 followed by application of a color contrast dye to portions 35 of the skeins. While it is usual practice to apply a base color, this is sometimes not done where, for example, the color of the undyed yarn is such as to provide the desired background for subsequently applied colors. When used, the base dye is conveniently applied by rotating the entire skein through a bath of the dye, or by rotating the skein while spraying the dye horizontally across the entire width of the skeins as in a Hussong machine. In either case, the skeins are rotated through their entire circumferences. One or more contrast colors are then applied in the same way except that the skeins are rotated only a discrete distance through the bath or, preferably, the skeins remain in fixed position facing a spray bank, so that only portions of the skein circumference are dyed. In either case, the entire width of the skeins, horizontally, is dyed. The "dip length" (length of the dye pattern on the circumference of the skein) of the contrast colors is regulated in a known way as desired as also is the number of contrast colors applied to the skeins. The amount and concentration of dye either in the dip technique or the spray technique may be regulated in accordance with well-known exhaust dyeing techniques so that substantially all of the dye is used in each application. This minimizes the need to clean the apparatus prior to application of another color or to substitute other dye tubes.

FIGS. 4 and 5 illustrate contrast color dye patterns on yarn 36 unwound from skeins 34. As a result of contrast color dyeing of the lower portions of the skeins as illustrated in FIG. 3, regularly spaced portions along the lengths of the yarns will be dyed. Thus, in FIG. 4 the upper dip margin of the dyed portion of skeins 34 is indicated by discontinuous line 37 and in FIG. 6, the four segments shown corresponding, on the average, to four circumferences or "wraps" of the skeins 34. The heavy-ruled portions 38 within each of the four segments of yarn 36 of FIG. 6 represent portions of yarn wraps which have been dyed with a color contrast dye, corresponding to the dyed portions 35 of the skeins of FIG. 3. As is evident, the color contrast pattern is repeated, on the average, for each wrap of the skein. Such regularity will be reflected as chevroning in fabrics made from the yarn.

FIGS. 6–8 show skeins and yarn dyed according to the invention as described with reference to FIGS. 3–5, a base dye is usually applied to the entirety of the skeins first. However, in contrast to the method of FIGS. 3–5, only certain discrete portions of the skeins are contrast color dyed, horizontally, across the widths of the skeins. The difference may also be described in terms of a discrete, undyed space between dyed portions 39 and 41, below a horizontal line across the width of the skeins. The effect of this discontinuity, horizontally, is schematically illustrated in FIGS. 7 and 8 where, in contrast to the regular intervals of dyed portions 38, there is exhibited irregular dyeing along the length of the yarn 42, corresponding to portions of the skeins below the upper dip margin line 43. Again, four circumferences or "wraps" of the skein are shown wherein wrap 1 has a dyed portion 44 corresponding to yarn in the dyed portion 39 of the skein in FIG. 6, this being the portion of the yarn below the dip margin line 43 of FIG. 7. The undyed space on the skein between between dyed portions 39 and 41 of FIG. 6 corresponds to undyed wrap 2 in the yarn of FIG. 8. Similarly, the wider dyed portion 41 corresponds to the sum of the dyed portions of adjacent wraps 3 and 4 of FIG. 8. Accordingly, whereas the color contrast repeat length in the yarn 36 of FIG. 5 is only a single circumference or wrap of the skein, the color contrast repeat length in yarns 42 of the invention illustrated in FIGS. 6–8 is greater than a single circumference or wrap of the skein. In the embodiment of the invention of FIGS. 6–8, the color contrast repeat length is at least four circumferences or wraps of the skein, on an average.

It will be understood that FIGS. 3–8 represent only simple cases of color contrast repeat lengths and then only average repeat lengths. For example, each of the "wraps" illustrated actually represent many such wraps of yarn in the skein. While the effect is based upon statistical averages of color contrast repeat lengths, nevertheless the non-chevroning result follows from asymmetric dyeing, i.e., the simple expedient of not applying a contrast color across the entire width, horizontally, of the skein. As will become evident from a consideration of FIGS. 10–13, the benefits of the invention may be achieved by using other than straight dye tubes and intermittent horizontal spacing of dye discharge outlets in such tubes. Skein dye patterns having upper dip margins which are not fully continuous on a horizontal line across the width of the skeins will also exhibit, in the yarns unwound therefrom, the random dyeing of the invention, and therefore the avoidance of chevroning in fabrics made with the yarns.

Figure 2:
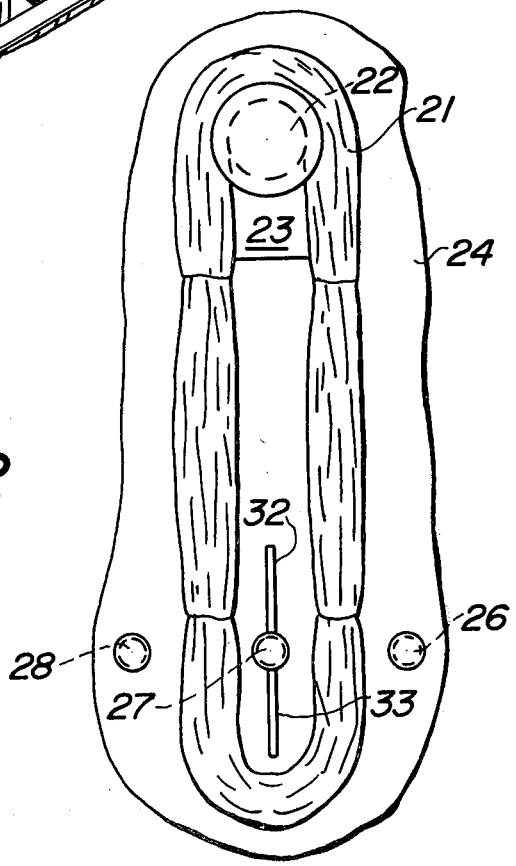
FIG. 2 is an end view from the left side of FIG. 1 with certain modifications therein.

FIG. 9 illustrates some arrangements of dye discharge outlets when the dye delivery means are dye tubes such as illustrated in FIGS. 1 and 2. While FIG. 9 illustrates dye tube arrangements for color contrast dyeing only of a single skein, it will be understood that the arrangements may be multiplied for dyeing of multiple skeins, on a single arm or multiple arm Hussong machine. The dye tube arrangements of FIG. 9 are positioned relative to the skeins to be dyed generally as shown in FIG. 1. For example, dye tubes 45, 46, and 47 of FIG. 9*a* correspond to dye tubes 26, 27 and 28, respectively, of FIG. 1. For the sake of clarity of understanding relative to the skein dyeing system of FIG. 1, the dye tubes in the arrangements of FIG. 9 will be referred to as a first dye tube (corresponding to tube 45 of FIG. 9*a* and tube 26 of FIG. 1), a second dye tube (the center dye tube, corresponding to tube 46 of FIG. 9*a* and tube 27 of FIG. 1) and a third dye tube (corresponding to dye tube 47 of FIG. 9*a* and tube 28 of FIG. 1).

Figure 9A:
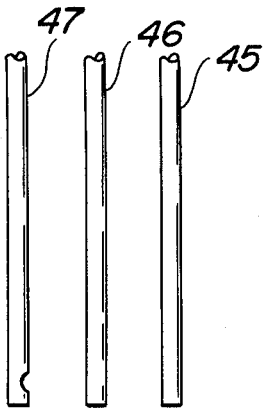
Figure 9B:
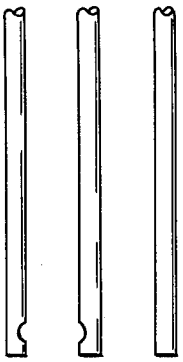

FIGS. 9*a* through 9*e* represent the simplest cases of dye tube arrangements. In FIG. 9*a*, only dye tube 47 has a dye discharge outlet and then only one such outlet. This will result in contrast color dyeing of a discrete portion only on one outer wall of a skein. After each application of a contrast color the skein is rotated to another position for application of the next color contrast dye. In FIG. 9*b*, the dye discharge outlet on the second (center) dye tube causes dyeing of an inner wall of the skein corresponding in position to the portion of the outer wall which is dyed in accordance with FIG. 9*a*. Generally, as shown in FIGS. 9*b* through 9*g*, it is preferred to simultaneously dye corresponding portions of a skein on corresponding inside and outside walls of a skein.

Figure 9C:
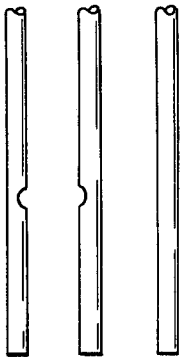
Figure 9D:
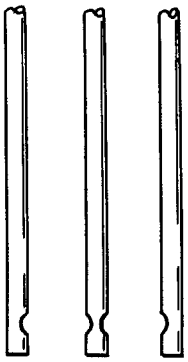
Figure 9E:
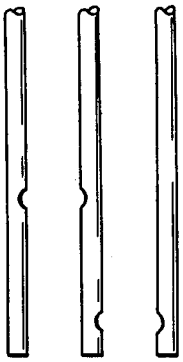
Figure 9F:
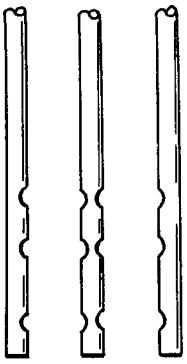
Figure 9G:
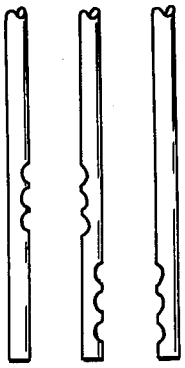

An arrangement similar to FIG. 9*b* is shown in FIG. 9*c* but with displacement of the dye outlets so that an intermediate portion on the width of a skein is dyed rather than an end portion as in FIGS. 9*a* and 9*b*. The arrangement of dye discharge outlets in FIG. 9*d* permits simultaneous dyeing of inside and outside wall portion of both walls of a skein. Similar simultaneous dyeing is achieved in the arrangements of FIGS. 9*e* through 9*g* but with varying degrees of displacement of the dye discharge outlets along the dye tubes so that different portions on different walls of the same skein are dyed simultaneously. The number of dye discharge outlets for dyeing of a discrete portion of a skein may be greater than one, as shown in FIGS. 9*f* and 9*g*, provided that there will result at least one undyed portion between dyed portions. This is provided for in all of the dye tube arrangements of FIG. 9, and more particularly in FIGS. 9*f* and 9*g* by the spacings between the dye discharge outlets in the dye tubes of these figures. Best results have been achieved by the arrangement of FIG. 9*g* and therefore this arrangement is a particularly preferred embodiment of the invention.

FIGS. 10–13 illustrate other embodiments of dye delivery means. With reference to FIGS. 10 and 11, bent or curved dye tubes are used in place of the straight dye tubes in FIGS. 1–9. Otherwise, the apparatus and results are generally in accordance with the arrangement shown in FIG. 1. The bent tube arrangements provide more positive dye transfer and delivery to portions of the skein to be dyed, since less reliance upon downward gravity flow of dye is necessary. The bent dye tubes 48, 49, and 51 of FIG. 10 are positioned in a Hussong machine relative to skeins to be dyed essentially as are tubes 26, 27, and 28 of FIG. 1. It will be noted that dye tube 48 has segments which are bent on an angle from the horizontal but otherwise span the width of a single skein. The resultant dye pattern 52, as shown in FIG. 11, correspondingly will have an upper color contrast dip margin on an angle to the horizontal. Similar dye patterns will result in skeins mounted in the Hussong machine adjacent the first skein except that the dye patterns will have upper dip margins at an angle complementary to those of the dye patterns of adjacent skeins. As in the case of multiple contrast color dyeing described in reference to FIG. 1, the skein may be rotated for application of another contrast color dye and then to other positions for application of other contrast colors, such as the dye portions 53 and 54 of FIG. 11.

If all three bent delivery tubes of FIG. 10 have dye discharge outlets in corresponding positions, there will result simultaneous dyeing of both outer walls and both inner walls of the skeins. However, this result may be changed by using arrangements of dye discharge outlets as indicated in FIG. 9. It should be understood that the asymmetric dye patterns of the invention are achieved by intermittent dyeing across the width of a skein on a horizontal line, this effect being evident in respect to the bent tube arrangements of FIGS. 10 and 12 in that the dye pattern slopes at an angle from the horizontal.

Another form of bent dye delivery tube is shown in FIG. 12. In this figure, the dye tubes are doubly bent for each skein to be dyed so that the resultant pattern again is angled to the horizontal and is characterized by a V-shaped upper dip margin. One such resultant color contrast dip pattern 56 is shown in FIG. 13. It will be understood that more than one color contrast dip pattern may be applied, in the manner described with reference to FIGS. 1 and 10, such as the patterns 57 and 58 in FIG. 13.

Generally, in practicing the method of the invention, the different contrast colors will be spaced equidistantly on the circumference of the skein. For example, if three different colors are to be applied to a skein over a base color, the first contrast color will be applied while the skein is in a stationary position and then the skein will be rotated 120° for application of the second contrast color. After application of the second contrast color, the skein will again be rotated 120° and the third contrast color applied. Of course, the amount and concentration of the dye of each application will be controlled for substantial exhaustion of the dye so that the need to clean or substitute dye delivery tubes will be minimized or avoided. While three or four contrast colors is the usual commercial range for contrast color skein dyeing, additional colors may be applied, if desired.

It will be evident that the position of the dye delivery means (such as the dye tubes illustrated in the drawings) relative to the skeins will determine the circumferential length ("dip length") of the resulting dye patterns on the skeins. For example, if the dye tubes are positioned close to the bottom of the skein, the dye pattern will have a short dip length. The dip length will be correspondingly longer if the dye tubes are more elevated with respect to the skeins. Dip lengths of about 10 to 50 inches of skein arc for two contrast color dyeings are acceptable for a 92 inch circumference skein but the dip lengths may be changed, of course, depending upon the number of contrast colors to be applied and the size of the skeins. Dip widths of about 3 to 4 inches at their widest points, using skeins of about 11 inches width, are acceptable but this dimension may be also changed in accordance with skein dimensions and the number of contrast colors to be applied. Other dyeing conditions, such as yarn type and denier, dyeing rate, dye bath concentration and temperature, dye application pressure and selection of dyes or dyestuffs (which terms are used herein interchangeably) are not critical to the invention and may be varied in accordance with the practice of the art.

It will also be understood that the extent to which chevroning can be prevented by practice of the invention may vary somewhat, depending on the selection of dye delivery means, mode of application of the dyes (spray, stream, dipping, kiss roll application, or the like) and various other conditions such as those described above or in the example. Since perfect non-chevroning is not required in all cases (as in hi-low loop and high pile carpets where a low degree of chevroning will be hidden), less than perfect prevention of chevroning is within the scope of the invention. The major benefit of the invention is the ability for the first time to regulate the degree of chevroning in fabrics made with yarns of the invention, depending on the end use for which the contrast colored yarn is destined.

The following example illustrates a preferred embodiment of the invention. However, it will be recognized that many variations are possible and come within the scope thereof. Accordingly, the invention is not limited to the specific details set forth in the foregoing description or in the example and various other modifications are equivalent for the stated and illustrated functions without departing from the spirit and scope of the invention.

EXAMPLE

Nylon yarn having two plies of 1300 denier each is formed into skeins of about 92 inch circumference, 14 inches width, and 7 lbs. weight. Each skein is loosely tied with eight leases at approximately equal intervals on the circumference of the skeins. Three of the skeins are hung adjacently on the arm of a one-arm Hussong dyeing machine. The machine is equipped with three straight dye delivery tubes positioned substantially as shown in FIG. 1. The center tube has dye discharge outlets along substantially its entire length on opposing sides of the tube in a horizontal plane. Each of the outer dye tubes also has dye outlets along one side of their entire lengths, directed towards the outer walls of the skein. The tubes are one inch in diameter and each dye outlet hole is 3/32 inches in diameter milled at a 10° angle downwardly from the horizontal. The holes are set at approximately 3/8 inch intervals.

A blue base color is sprayed onto the skein through the dye tubes as the skein is slowly rotated, the spray pressure being about 3–3.5 psig. After application of the base shade, the tubes are replaced with tubes having dye discharge outlets arranged as shown in FIG. 9*g*, the arrangement being repeated three times along the length of the tubes so that the same spray pattern is applied simultaneously to all three skeins. The tubes are 1 inch in diameter and each outlet hole is 3/32 inches in diameter milled at a 10° angle downwardly from the horizontal. The holes in each set of three are ⅜ inch apart. The portion of the skeins exposed to dye spray from the dye tubes is set by raising or lowering the skeins on the arm of the Hussong machine. In this manner, dip length (distance on the bottom circumference of the skein between the outlet holes of the two outer dye tubes) of about 24 inches is set.

The dye bath temperature is then set at 170° F. and the pH at 7.2–7.5. Dye liquor pressure in the dye tubes is 6 psig. While the skeins are held stationary on the arm of the Hussong machine the portions of the skeins adjacent the dye discharge outlets are dyed green against the blue base color. The dimensions of the dyed portions on each side of the skein on the arm of the Hussong machine are approximately 14 inches high, 3½ inches wide at the top and 6 inches wide at the bottom. Substantially idential dye patterns are observed on the inner walls of the skeins. The dye pattern spacing on the width of each skein corresponds to the position of the outlet holes in the dye tubes. During application of the dye, the temperature of the dye bath rises and is controlled so that it rises no more than 2° F. per minute and does not rise over 210° F. During the temperature rise, the pH is adjusted slowly to 5.5–5.0. The spraying is continued for about 15 minutes at 210° F. or until the dye liquor is exhausted.

After the first contrast color is applied the skeins are rotated 120° and then held stationary for application of the next contrast color (brown) essentially as described. A third contrast color (navy blue) is thereafter applied in essentially the same manner to give a four color yarn. The yarn is tufted into a cut pile, a loop pile, or a cut and loop pile carpet. No chevroning is observed in the carpets.

What is claimed is:

1. Apparatus for random skein dyeing of yarn, including rotatable support means for axially supporting and rotating at least one skein thereon, first and second dye delivery means below said support member and spaced apart on opposing sides of said skein and generally parallel to said sides, said first dye delivery means being adjacent an exterior side of said skein and said second dye delivery means extending through said skein, said dye delivery means having dye discharge outlets positioned to discharge dye to at least one discrete location on said skein but to less than the number of locations effective for dyeing across the full width of said skein, and said dye delivery means being devoid of other dye discharge outlets.

2. Apparatus as in claim 1 wherein said dye discharge outlets are positioned to discharge dye for horizontal contact with no more than half the width of said skein.

3. Apparatus as in claim 1, further including shield means on said second dye delivery means for preventing transfer of dye from one wall of said skein through to the opposing wall of said skein.

4. Apparatus as in claim 1 including third dye delivery means adjacent the exterior wall of said skein and opposite said first dye delivery means, said third dye delivery means having at least one discharge outlet corresponding in position to the opposing dye discharge outlets in said second dye delivery means.

5. Apparatus as in claim 4 wherein said dye discharge outlets in said first and third dye delivery means correspond in position.

6. Apparatus as in claim 4 wherein said dye discharge outlets in said first and third dye delivery means are at different positions.

7. Apparatus as in claim 4 wherein the number of opposing dye discharge outlets in said dye delivery means is equal.

8. Apparatus as in claim 4 wherein the number of opposing dye discharge outlets in said dye delivery means is unequal.

9. Apparatus as in claim 4 wherein said dye delivery means comprise straight or bent dye tubes.

10. Apparatus as in claim 9 wherein said dye tubes are bent in vertical planes at an angle to the horizontal effective to form a dye pattern having a V-shaped upper margin.

* * * * *